US010280718B2

(12) United States Patent
Broussard et al.

(10) Patent No.: US 10,280,718 B2
(45) Date of Patent: May 7, 2019

(54) GRAVEL PACK APPARATUS HAVING ACTUATED VALVES

(71) Applicant: Weatherford Technology Holdings, LLC, Houston, TX (US)

(72) Inventors: John P. Broussard, Kingwood, TX (US); Christopher A. Hall, Cypress, TX (US); Ronald van Petegem, Montgomery, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 223 days.

(21) Appl. No.: 15/242,515

(22) Filed: Aug. 20, 2016

(65) Prior Publication Data

US 2016/0356129 A1 Dec. 8, 2016

Related U.S. Application Data

(63) Continuation of application No. 13/738,713, filed on Jan. 10, 2013, now Pat. No. 9,441,454, which is a continuation-in-part of application No. 13/661,710, filed on Oct. 26, 2012, now abandoned.

(51) Int. Cl.

| | |
|---|---|
| ***E21B 33/12*** | (2006.01) |
| ***E21B 34/06*** | (2006.01) |
| ***E21B 43/04*** | (2006.01) |
| ***E21B 43/08*** | (2006.01) |
| *E21B 34/00* | (2006.01) |

(52) U.S. Cl.

CPC ..... *E21B 43/045* (2013.01); *E21B 33/12* (2013.01); *E21B 34/06* (2013.01); *E21B 43/08* (2013.01); *E21B 2034/002* (2013.01); *E21B 2034/007* (2013.01)

(58) Field of Classification Search

CPC ..... E21B 43/045

See application file for complete search history.

(56) References Cited

U.S. PATENT DOCUMENTS

| | | | | |
|---|---|---|---|---|
| 3,134,439 | A * | 5/1964 | Shields, Jr. | E21B 43/045 166/143 |
| 4,428,428 | A * | 1/1984 | Smyrl | E21B 34/063 166/278 |
| 5,597,040 | A | 1/1997 | Stout | |
| 5,609,204 | A * | 3/1997 | Rebardi | E21B 17/06 166/227 |

(Continued)

FOREIGN PATENT DOCUMENTS

| | | | |
|---|---|---|---|
| EP | 0482930 | A2 | 4/1992 |
| EP | 1225302 | A2 | 7/2002 |

(Continued)

OTHER PUBLICATIONS

Search Report in counterpart European Appl. 13190286.8, dated Jun. 30, 2014.

(Continued)

*Primary Examiner* — Blake E Michener

(74) *Attorney, Agent, or Firm* — Blank Rome, LLP

(57) ABSTRACT

A device and method allows a bore valve in the washpipe and in certain instances a port valve or sliding sleeve to open or close upon command from the surface so that gravel slurry may be placed in a wellbore.

25 Claims, 7 Drawing Sheets

(56) References Cited

U.S. PATENT DOCUMENTS

| | | | | |
|---|---|---|---|---|
| 5,921,318 | A * | 7/1999 | Ross | E21B 33/124 166/126 |
| 6,216,785 | B1 * | 4/2001 | Achee, Jr. | E21B 33/124 166/278 |
| 6,382,319 | B1 * | 5/2002 | Hill, Jr. | E21B 43/045 166/194 |
| 6,491,097 | B1 | 12/2002 | Oneal et al. | |
| 7,147,054 | B2 | 12/2006 | Wang et al. | |
| 7,661,476 | B2 | 2/2010 | Yeh et al. | |
| 9,441,454 | B2 * | 9/2016 | Broussard | E21B 34/06 |
| 2002/0195253 | A1 * | 12/2002 | Hill, Jr. | E21B 21/10 166/380 |
| 2003/0111224 | A1 * | 6/2003 | Hailey, Jr. | E21B 34/06 166/278 |
| 2005/0103495 | A1 * | 5/2005 | Corbett | E21B 34/14 166/278 |
| 2006/0231253 | A1 * | 10/2006 | Vilela | E21B 37/08 166/278 |
| 2007/0187095 | A1 | 8/2007 | Walker et al. | |
| 2009/0025923 | A1 | 1/2009 | Patel | |
| 2009/0301723 | A1 | 12/2009 | Gray | |
| 2010/0163235 | A1 | 7/2010 | Mootoo | |
| 2010/0230098 | A1 | 9/2010 | Craig | |
| 2012/0103608 | A1 * | 5/2012 | van Petegem | E21B 17/07 166/278 |
| 2013/0014953 | A1 * | 1/2013 | van Petegem | E21B 34/14 166/308.2 |
| 2013/0062066 | A1 | 3/2013 | Broussard et al. | |
| 2013/0118726 | A1 | 5/2013 | Broussard et al. | |
| 2013/0118732 | A1 * | 5/2013 | Chauffe | E21B 34/06 166/250.04 |
| 2013/0140041 | A1 * | 6/2013 | Allen | E21B 23/06 166/387 |
| 2014/0096963 | A1 * | 4/2014 | Sharma | E21B 43/045 166/278 |
| 2015/0068743 | A1 | 3/2015 | Broussard et al. | |
| 2016/0237783 | A1 * | 8/2016 | Richards | E21B 34/14 |
| 2016/0356129 | A1 * | 12/2016 | Broussard | E21B 34/06 |

FOREIGN PATENT DOCUMENTS

| | | | |
|---|---|---|---|
| WO | 2008/070271 | A2 | 6/2008 |
| WO | 2009/015109 | A1 | 1/2009 |
| WO | 2010/127457 | A1 | 11/2010 |
| WO | 2012/037646 | A1 | 3/2012 |

OTHER PUBLICATIONS

First Examination Report in counterpart Australian Appl. 2013248172, dated May 6, 2015.

First Office Action in counterpart Canadian Appl. 2,830,393, dated Oct. 8, 2014.

* cited by examiner

2/7

GRAVEL PACK APPARATUS HAVING ACTUATED VALVES

CROSS-REFERENCE TO RELATED APPLICATIONS

This is a continuation of U.S. application Ser. No. 13/738,713, filed Jan. 10, 2013, which is a continuation-in-part of U.S. application Ser. No. 13/661,710, filed Oct. 25, 2012, and entitled "RFID Actuated Gravel Pack Valves," which is incorporated herein by reference in its entirety.

BACKGROUND

Hydrocarbon wells, horizontal wells in particular, typically have sections of wellscreens with a perforated inner tube and an overlying screen portion. The purpose of the screen is to block the flow of particulate matter into the interior of the perforated inner tube, which connects to production tubing. Even with the wellscreen, some contaminants and other particulate matter can still enter the production tubing. The particulate matter usually occurs naturally or is part of the drilling and production process. As the production fluids are recovered, the particulate matter is also recovered at the surface. The particulate matter causes a number of problems in that the material is usually abrasive reducing the life of any associated production equipment. By controlling and reducing the amount of particulate matter that is pumped to the surface, overall production costs are reduced.

Even though the particulate matter may be too large to be produced, the particulate matter may cause problems downhole at the wellscreens. As the well fluids are produced, the larger particulate matter is trapped in the filter element of the wellscreens. Over the life of the well as more and more particulate matter is trapped, the filter elements will become clogged and restrict flow of the well fluids to the surface.

A method of reducing the inflow of particulate matter before it reaches the wellscreens is to pack gravel or sand in the annular area between the wellscreen and the wellbore. Packing gravel or sand in the annulus provides the producing formation with a stabilizing force to prevent any material around the annulus from collapsing and producing undesired particulate matter. The packed gravel also provides a prefilter to stop the flow of particulate matter before it reaches the wellscreen.

In typical gravel packing operations, a screen and a packer are run into the wellbore together. Once the screen and packer are properly located, the packer is set so that it forms a seal between wellbore and the screen and isolates the region above the packer from the region below the packer. The screen is also attached to the packer so that it hangs down in the wellbore, which forms an annular region around the exterior portion of the screen. The bottom of the screen is sealed so that any fluid that enters the screen must pass through the screening or filtering material. The upper end of the screen is usually referred to as the heel and the lower end of the screen is usually referred to as the toe of the well.

Once the screen and packer are run into the wellbore but before they are run to their intended final location, a washpipe subassembly is put together at the surface and is then run downhole through the packer and into the screen. The run-in continues until a crossover tool on the washpipe subassembly lands in the packer. The entire assembly is then ready to be run into the wellbore to its intended depth.

Once the assembly of the screen, packer, washpipe, and crossover tool reaches its intended depth in the wellbore, a ball is pumped downhole to the crossover tool. The ball lands on one of two seats in the crossover tool. Once the ball lands on the first seat, pressure is applied from the surface across the ball and seat to set the packer and to shift a sleeve in the crossover tool. With the sleeve open, fluid, typically gravel slurry, may be pumped down the well through the washpipe. Physical manipulation of the crossover tool by raising the washpipe is required to position it properly relative to the screen and packer assembly so that fluid circulation can take place. When the slurry reaches the crossover tool, the gravel slurry is blocked by the ball and seat that was previously landed in the crossover tool. Instead, the ball and seat causes the gravel slurry to exit the crossover tool through a port that directs all fluid flow from inside of the washpipe above the packer to the outside of the washpipe and screen below the packer and into the annular space outside of the screen.

As the slurry travels from the heel of the well toward the toe along the outside of the screen, an alpha wave begins that deposits gravel from the heel towards the toe. All the while, the transport fluid that carries the gravel in the slurry drains inside through the screen. As the fluid drains into the interior of the screen, it becomes increasingly difficult to pump the slurry down the wellbore. Once a certain portion of the screen is covered, the gravel starts building back from the toe towards the heel in a beta wave to completely pack off the screen from approximately its furthest point of deposit towards the heel. As the gravel fills back towards the heel, the pressure in the formation increases.

The crossover tool has a second port that allows fluid to flow from the interior area of the screen below the packer to an annular area around the exterior of the washpipe but above the packer.

After the annular area around the screen has been packed with gravel, the crossover tool is again moved relative the screen and packer assembly to allow for fluid circulation to remove any slurry remaining in the washpipe above the packer. The flushed slurry is then disposed of at the surface. Then, a second ball may be pumped down the well to land in a second ball seat in the crossover tool. After the second ball has seated, pressure is applied from the surface to shift the sleeve in the crossover tool a second time as well as to seal off the internal bore of the crossover tool and to open a sleeve in a second location. Once the sleeve is shifted and is sealed in a second location, wellbore fluid from the surface flowing through the washpipe may be directed into an internal flowpath within the crossover tool and then back into the interior of the washpipe, thereby bypassing both the first and the second balls and seats. Once the fluid has been redirected to stay in the washpipe, the operator may reposition the washpipe and begin to acidize or otherwise treat the wellbore.

In the current system, fluid flow through the interior is limited by forcing the fluid to travel through a micro-annulus, which is the only path available in crossover tool. The only alternative is to reverse the washpipe and crossover tool completely out of the hole and run-in with an unobstructed washpipe. The additional trip out of the hole and then back in leads to additional time and expense in completing the well.

When typical seals as described above are used, care must be taken so that each lower seal and seat has a diameter that is smaller than the seal and seat above it. Such an inverted wedding cake arrangement helps to insure that the operator does not attempt to force a device through a seal that is too small thereby damaging the seal.

Such an arrangement may limit the diameter of the bore through a tubular. Also, typically once a device seals on a particular seat, the seat cannot be reused. When several seal and seats are needed in close proximity, the utility of the tool or tools may be limited.

SUMMARY

In a system according to the present disclosure, neither dropping various balls to land on seats nor making a second trip into and out of the well is necessary to treat the well. The system reduces the time to accomplish well operations and improves fluid flow through the interior of the washpipe.

In the system, controlling the fluid flow is achieved by replacing the balls and seats that were previously necessary to alter the flow paths with a valve and port system. This valve and port system uses a valve and ports that may be operated on demand using pressure pulses or a radio frequency identification device. In such an embodiment, any type of valve that can open and close off flow through a tubular may be used, such a butterfly or ball valve.

By operating the valve and port system on demand, the operator can close off the interior of a washpipe tool, while opening flow through a port for gravel packing the wellbore. When the gravel packing is complete, the operator may then open the interior of the washpipe tool to flow from the casing and into the washpipe. This flow removes excess sand slurry from the washpipe in a reverse circulating process. Once sufficient reverse circulation has been performed, the port allowing the reverse circulation as well as the flow through port can be closed by operating valves. At this point, a port system can be opened to realize improved flow through the interior of the washpipe without having to run out of and then back into the wellbore.

In the new system, neither a second trip into and out of the well is necessary to treat the well while greatly improved fluid flow through the interior of the casing thereby potentially allowing a larger diameter screen and consequently a larger washpipe may be used with the same technique allowing greater flow through the washpipe, even when no increase in washpipe diameter is achieved.

The fluid flow may be improved by replacing the seal in the packer and the balls and seats in the washpipe with variable diameter seats that may be operated on demand such as by pressure pulses or a radio frequency identification device.

A variable diameter seat has utility in any device where a seat diameter is a limiting factor when compared to the bore diameter and when the seat and seal are only required on demand.

One embodiment of the variable diameter seal has a seat that is a combination of several portions. When the seat is not necessary, the portions may be held radially outward so that an increased diameter of the bore may be accessed, such as when a large diameter tool, dart, or ball is required to pass through. However, when the seat is required for a ball or dart to seal upon it, then, on command from the surface, the seat may move radially inward so that the various pieces combine to form at least a seat and possibly even a seal against fluid flow through the bore and past the seat.

When the operator determines that the seat is no longer necessary, then the operator may send a second signal to unlock the seat and move it radially outward once again. The command from the surface may be radio, low frequency radio, pressure pulse, a fiber optic line, an electric line, or a radio frequency identification device.

Another embodiment utilizes a collet and a sleeve. The sleeve could be removed from the collet fingers so that any tool, dart, or ball, when reaching the collet fingers could pass by without interacting with the collets finger. In the potential instance where the tool, ball, or dart does interact with the collet fingers, the tool would merely push the collet fingers radially outward, with a minimal resistance, and continue downhole.

Once the operator determines that the seat is required, a signal may be sent for the surface to move the sleeve into position over the collet so that the fingers are moved radially inward or are at least held in a radially inward position so that the collet fingers will no longer allow an appropriately sized tool, ball, or dart to pass. Further, once the appropriately sized tool, ball, or dart lands on the seat, a seal across the bore may be formed.

In a further embodiment, at least the seals mentioned may be constructed so that they have an open condition as described above, however, when the signal is sent from the surface to move radially inward the seats are constructed so that once they have moved radially inward they completely obstruct the bore without the need of a ball, tool, or dart landing upon the seat. Each seal forms a complete seal by itself upon a command from the surface.

Such seals may be used in many different areas. They may be used to open and close gravel pack paths or to provide seats in sliding sleeves to open and close the sliding sleeve.

DETAILED DESCRIPTION

Figure 1:
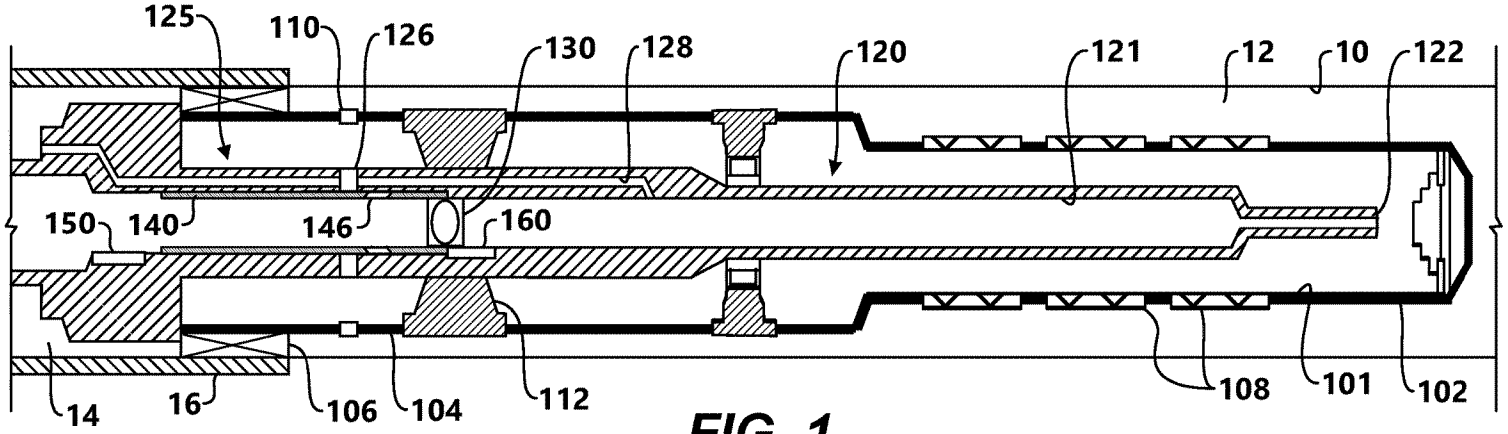
FIG. 1 depicts a wellbore having a screen assembly in a well and having a washpipe tool run into the screen assembly.

FIG. 1 depicts a screen assembly 100 located in a wellbore 10. The bottom or toe of the assembly 100 is designated at 102, and the upper end or heel of the assembly 100 is designated at 104 near casing 16. The sealing element 104 engages inside the wellbore 10 to restrict flow through an annular area 12. In particular, the sealing element 104 is set so that the sealing element 104 seals the screen assembly 100 in the wellbore 10 and forms the annular area 12 between the wellbore 10 and the screen's exterior. The sealing element 106, while typically a packer, may or may not have slips depending upon the wellbore 10 and the operator's requirements.

An inner workstring or washpipe tool 120 has been run into the downhole screen assembly 100. The washpipe tool 120 includes a crossover tool 125 and stings through the bore of the sealing element 106 and seals on the interior bore of the element 106 with at one or more seals or seats 112. The crossover tool 125 may be configured to allow fluid to flow down through the washpipe's main bore 121. Alternatively, the crossover tool 125 may be configured to divert flow out through one or more outlet ports 126 on the tool 125 with the return fluid being able to pass through an interior passageway 128. A bore valve 130 is disposed in the crossover tool 125. As shown in FIG. 1, the bore valve 130 is in an open condition to allow fluid to flow through the main bore 121 of the washpipe 120. The bore valve 130 can be a butterfly valve or a ball valve, although any other type of valve mechanism can be used.

The outlet port 126 is located downhole from sealing element 106. In general, the outlet port 126 may or may not have a port valve 140 for opening and closing the outlet port 126. For example, the port valve 140 can be a sliding sleeve movable to expose or isolate the outlet port 126 for fluid flow. In FIG. 1, the crossover tool 125 does include an internal port valve 140, shown here as a sliding sleeve 140 having a bypass port 146. When the sliding sleeve 140 is in a closed condition with its bypass port 146 closed relative to the outlet port 126, fluid is prevented from flowing out of the crossover tool 125, through the bypass port 146, out the outlet port 126 in the screen assembly 100, and into the annular area 12 between the screen assembly 100 and the wellbore 10. The port valve 140 can use any other type of valve mechanism available in the art to control fluid flow through the outlet port 126.

The crossover tool 125 further includes a signal receiver 150 and an actuator 160 disposed thereon. Depending on the type of electronics used, the signal receiver 150 can detect pressure pulses, radio frequency identification devices, or other signals communicated from the surface. In response to a received signal by the receiver 150, the actuator 160 performs an appropriate action to configure the crossover tool 125 for different operations, as described below. The actuator 160 can use any of a number of suitable components, such as a linear or rotary actuating mechanism, and can have a power source, electronics, and other components, which are not detailed herein but would be appreciated by one skilled in the art having the benefit of the present disclosure.

Figure 2:
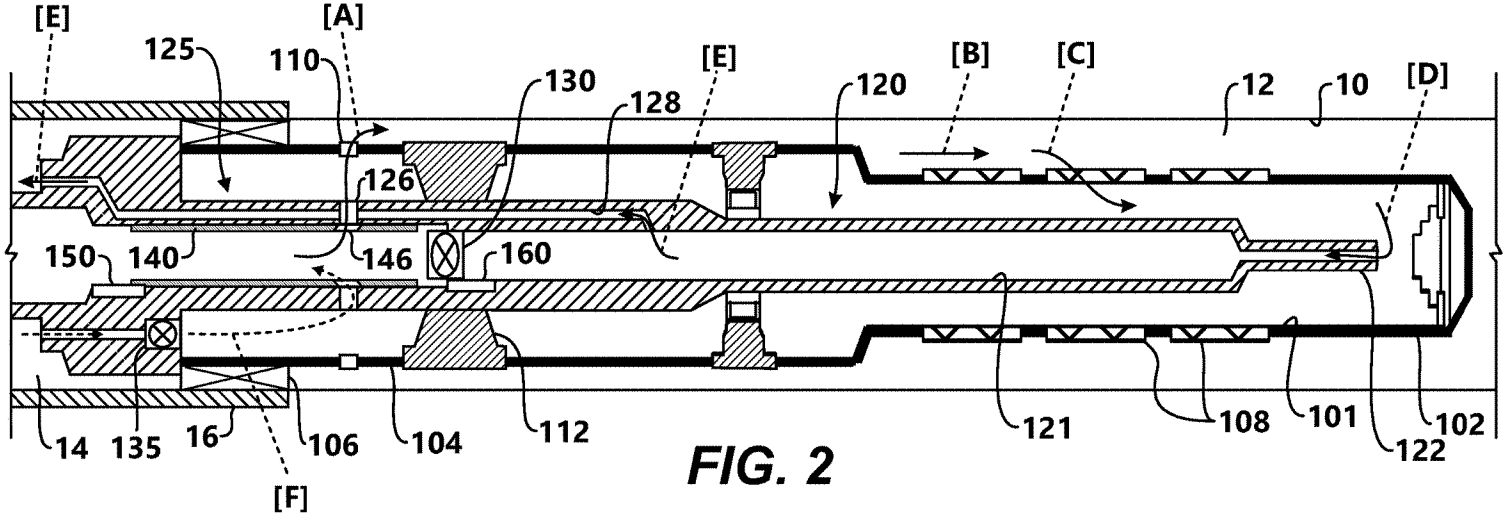
FIG. 2 depicts the crossover of the washpipe tool with a bore valve closed and with a port valve opened.

Prior to commencing a gravel packing operation, the crossover tool 125 is changed from its run-in configuration of FIG. 1 to a gravel packing configuration as depicted in FIG. 2. A signal is sent from the surface (not shown) downhole to the crossover tool 125 by a pressure pulse, a radio frequency identification device (not shown), or any other known means. Once the signal receiver 150 obtains the proper signal to reconfigure the crossover tool 125, power is supplied, typically by the actuator 160, so that the bore valve 130 is moved from an open condition to a closed condition so that fluid flow through the interior bore 121 of the washpipe 120 is prevented. Based upon the same or a different signal the signal receiver 150 receives, power is supplied by the actuator 160 to move the second valve or sliding sleeve 140, thereby opening the bypass ports 146 to allow fluid to flow from the interior bore 121 of the washpipe 120 through the outlet ports 126 in the screen assembly 100 and into the annular area 12.

The actuator 160 can supply power to both the sliding sleeve 140 and the bore valve 130 to either open or close the sliding sleeve 140 and the bore valve 130. In certain embodiments, two or more actuators 160 can be utilized to power the bore valve 130 and sliding sleeve 140 independently. As noted above, the actuator 160 can be any type known in the industry including rotary or linear actuators.

Once the crossover tool 125 is configured, gravel slurry (not shown) is pumped down the washpipe tool 120. The slurry exits the ports 146 and 126 and takes the path of least resistance (as indicated by directional arrow A) and flows out 110 towards the toe 102 of the annulus 12 (as indicated by directional arrow B). As the gravel slurry moves towards the toe 102 of the annulus 12, the fluid portion of the gravel slurry flows through screens 108 into the interior 101 of the screen assembly 100 (as indicated by directional arrow C). As the fluid flows into the interior 101 of the screen assembly 100, the gravel is deposited or "packed" around the exterior of the screen assembly 100.

The fluid returns passing into the assembly 100 then flow in to the interior 121 of the washpipe 120 through port(s) 122 (as indicated by directional arrow D). The fluid continues upward through the washpipe 120 to the crossover tool 125 where the fluid enters the interior passageway 128 (as indicated by directional arrow E). The fluid bypasses the closed bore valve 130 and exits the crossover tool 125 into an annular area 14 uphole of the assembly's sealing element 106.

After the gravel packing operation is complete, it may be desirable to circulate out excess slurry from the washpipe tool 120. To do this, the washpipe tool 120 can be reconfigured for reverse circulation. In general, the crossover tool 125 and washpipe tool 120 can be lifted from the sealing element 106 to allow fluid flow in the casing annulus 14 to flow into the washpipe's bore 121 through the ports 126 and back up the washpipe tool 120.

Alternatively, the washpipe tool 120 is not lifted and is instead reconfigured by sending a second signal to the signal receiver 150. Once the signal receiver 150 receives the proper signal to reconfigure the crossover tool 125, power is supplied by the one or more actuators 160 so that another valve (e.g., 135) is moved from a closed condition to an open condition so fluid is allowed to flow from the casing annulus 14 above the sealing element 106 into the crossover tool 125 and through the interior bore 121 of the washpipe 120 (as indicated by directional arrow F). This fluid path permits circulation, known as reverse circulation, to remove excess sand slurry left in the washpipe 120 after the gravel pack operation. As opposed to the valve 135 in the position indicated, a valve in another position can be used for similar purposes.

Figure 3:
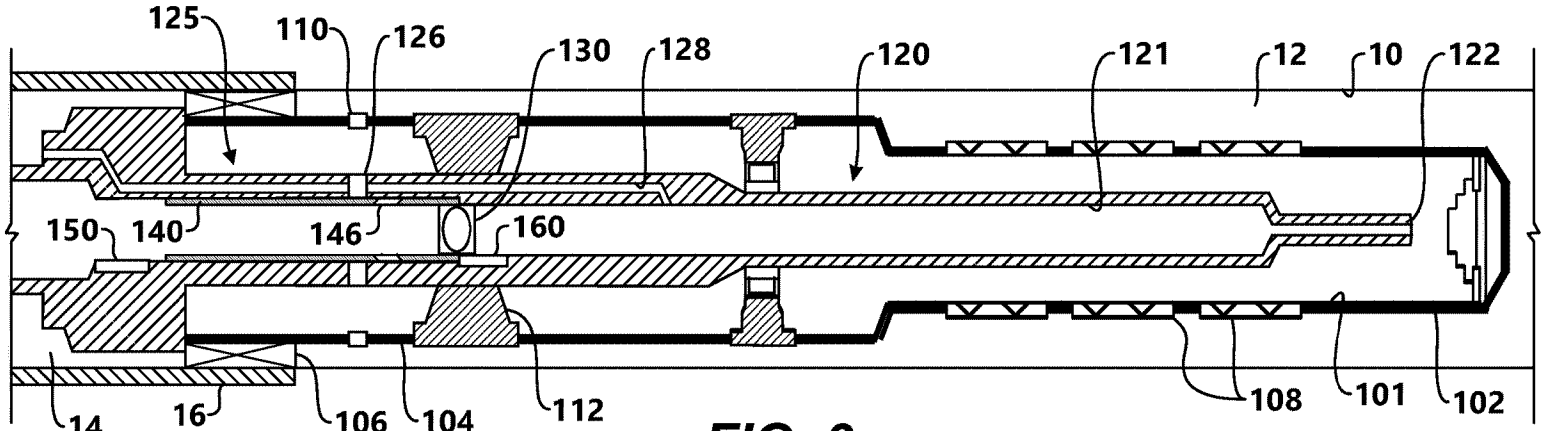
FIG. 3 depicts the crossover of the washpipe tool with the bore valve opened and with the port valve closed.

After the reverse circulating operation is complete, the washpipe tool 120 is reconfigured by sending a third signal to the signal receiver 150 as depicted in FIG. 3. Once the signal receiver 150 receives the proper signal to reconfigure the crossover tool 125, power is supplied by actuator 160 so that the bore valve 130 is moved from the closed condition to an open condition where fluid flow through the interior bore 121 of the washpipe 120 is allowed. Based upon the same or different signal that the signal receiver 150 receives to open the bore valve 130, power is supplied to move the sliding sleeve 140 from its open condition to its closed condition, closing bypass ports 146 to prevent fluid to flow from the interior bore 121 of the washpipe tool 120 into the annular area 12. Moreover, if a recirculation valve (e.g., 135) is used, it too may be closed at this point.

Figure 4:
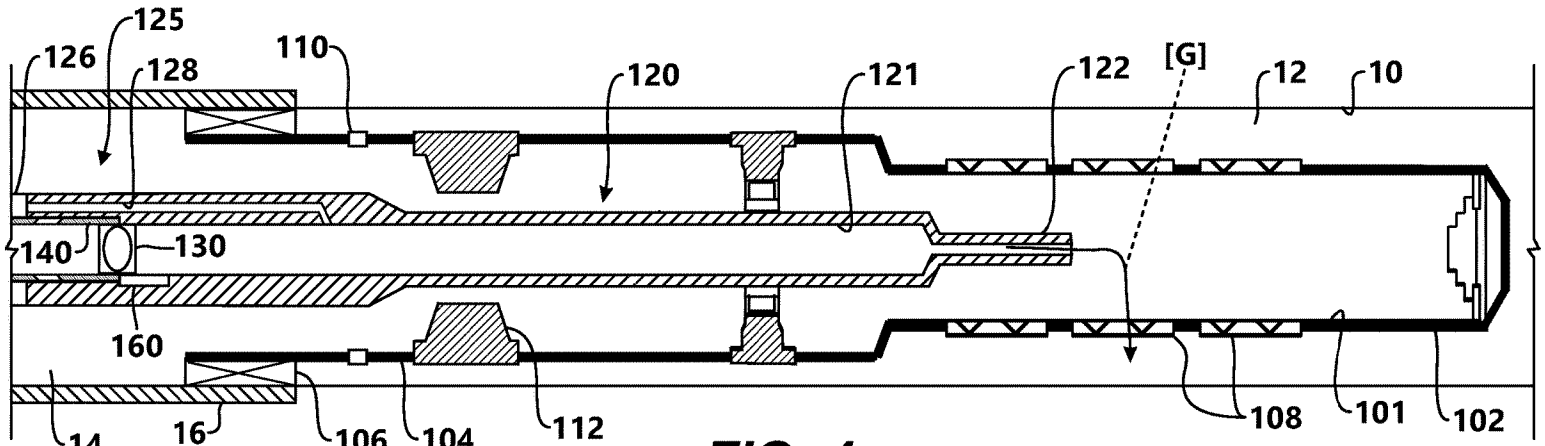
FIG. 4 depicts the washpipe tool relocated in the screen assembly to treat the well.

As now depicted in FIG. 4, once the bore valve 130 is opened and the ports 146 and 126 are closed by the port valve 140, the operator may pump any desired wellbore treatment through the essentially full inner bore 121 of the washpipe 120. As further shown, the operator may reposition the washpipe tool 120 to position the ports 122 near the portion of the screens 108 that the operator desires to treat. Directional arrows G indicate the general direction of the fluid flow for such a treatment operation.

Additional gravel pack valves actuated by RFID or other methods are disclosed in incorporated U.S. application Ser. No. 13/661,710. These other gravel pack valves can be used for any of the various valves (e.g., 130 and 140) disclosed herein. For example, as noted above, the bore valve 130 can be a butterfly valve or a ball valve, although any other type of valve mechanism can be used including a ball and seat mechanism as disclosed in the incorporated U.S. application Ser. No. 13/661,710 and operable via a pressure pulse, RFID device, or other signal.

Figure 5A:
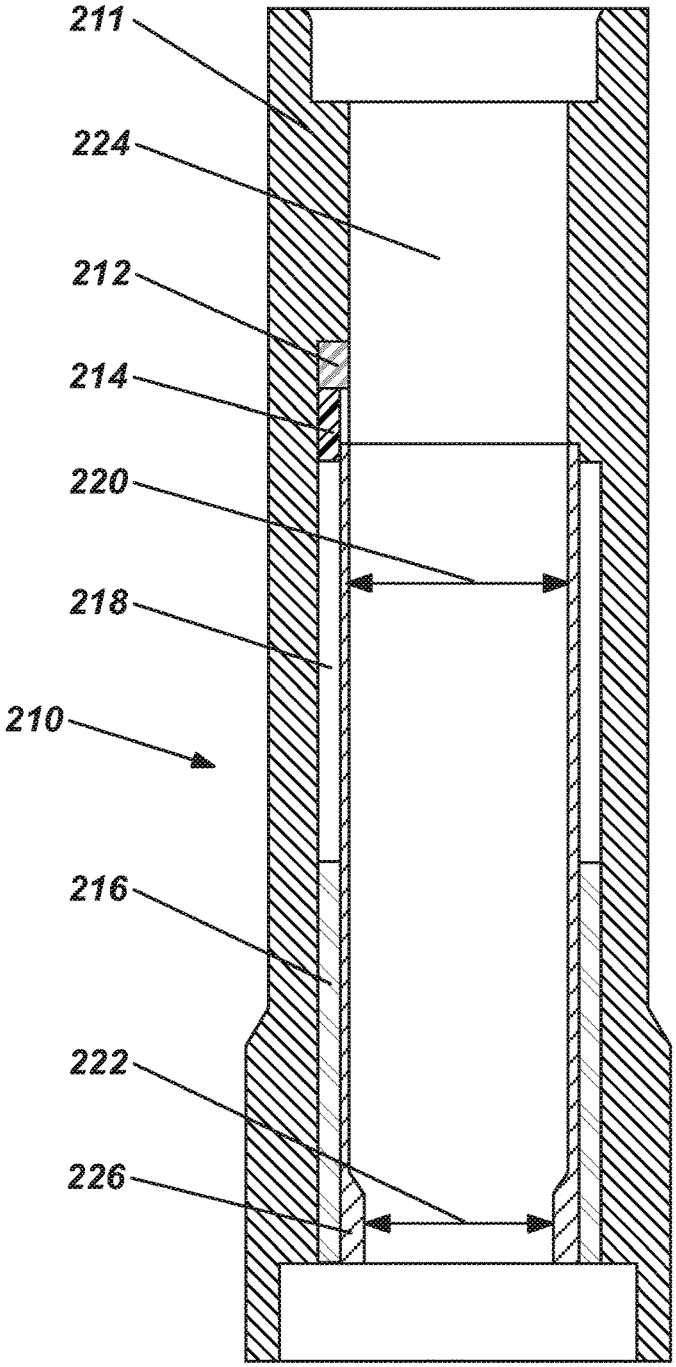
FIG. 5A depicts a collet type radial movable seat operable from the surface in its catching condition.

FIG. 5A depicts a collet 210 in its radially locked condition in a housing 211 so that a ball, dart, or other tool, of the appropriate size, will be caught by the collet 210. To operate the collet 210, a receiver 212 will receive a signal communicated from the surface by a radio frequency identification device, a pressure pulse, or by other means known in the industry. When the receiver 212 receives the appropriate signal, the receiver 212 causes the actuator 214 to move the lock 216 upwards or downwards, in this case the lock 216 is shown in its downward position, in channel 218. In the radially locked condition, the collet 210 at the collet fingers 226 has a diameter 222 that is less than the main bore diameter 220 such that a ball, dart, or tool that could pass through the main bore 24 will be caught by the collet fingers 226. The collet 210 could be attached to a sliding sleeve or other device where force needs to be applied across a ball and seat.

Figure 5B:
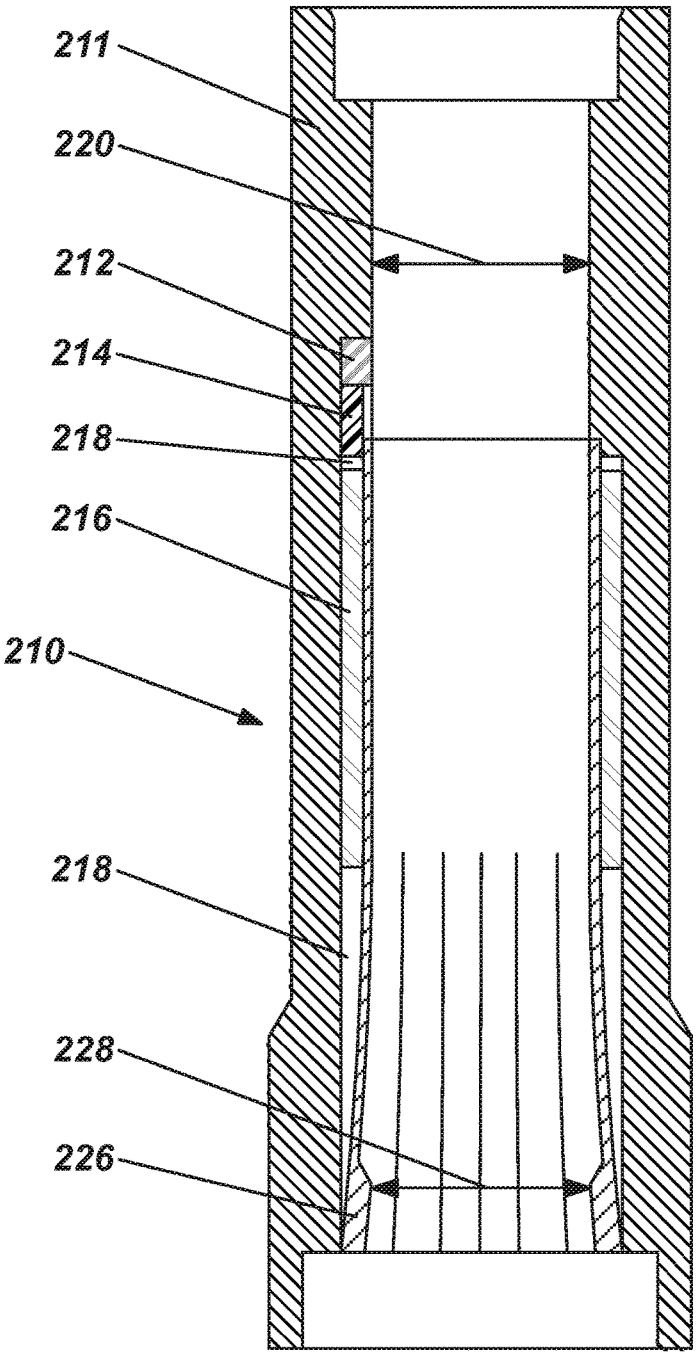
FIG. 5B depicts the collet type radial movable seat operable from the surface in its released condition.

FIG. 5B depicts the collet 210 in its radially unlocked condition. In the radially unlocked condition, the collet fingers 226 are not able to catch a ball, dart, or other tool. To change the condition of the collet 210 from the locked condition to the unlocked condition the receiver 212 receives a signal communicated from the surface by a radio frequency identification device, a pressure pulse, or by other means known in the industry. When the receiver 212 receives the appropriate signal, the receiver 212 causes the actuator 214 to move the lock 216 upwards in channel 218. By moving the lock 216 upwards, the collet fingers 226 are allowed to move radially outwards into channel 218. In the radially unlocked condition the collet 210, at the collet fingers 226, has a diameter 228 that is sufficient to allow a ball, dart, or tool that could pass through the main bore 224 to pass through collet 210.

Figure 6A:
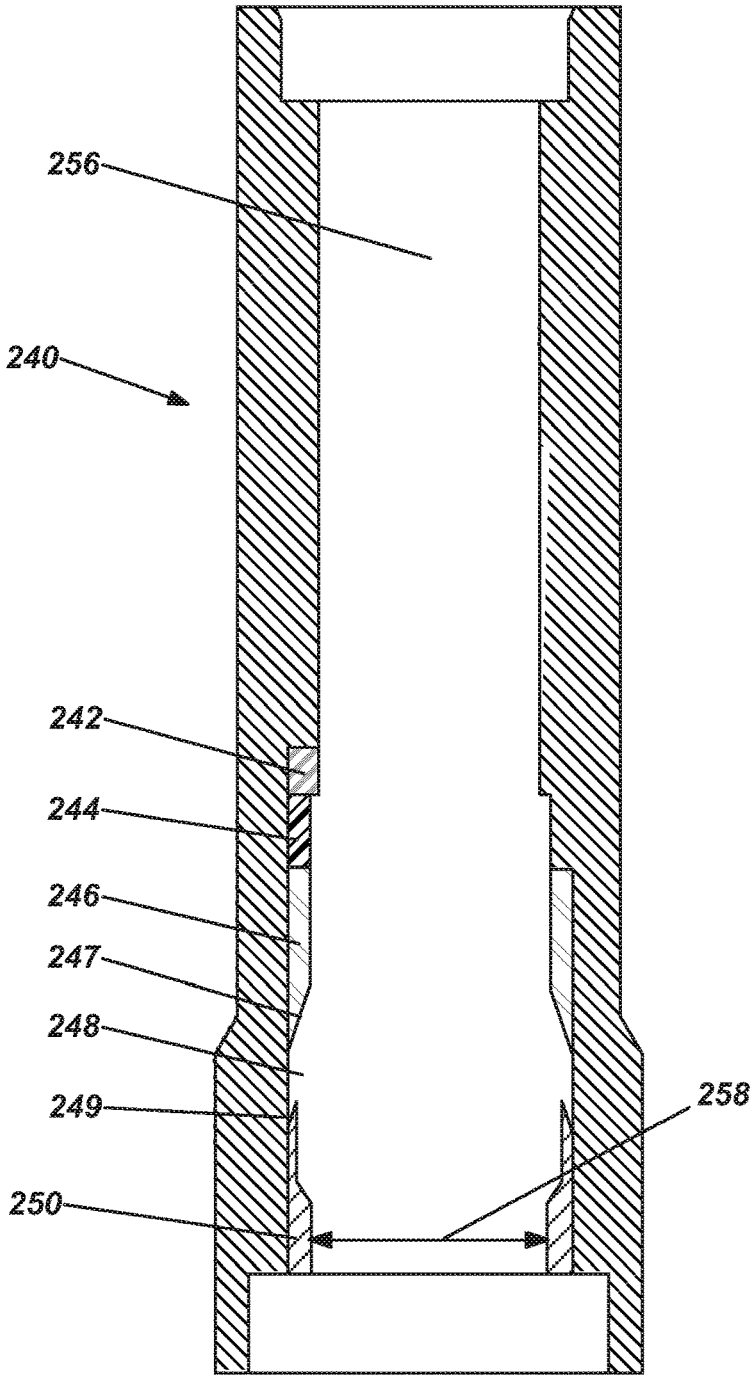
FIG. 6A depicts the collet type segmented seat in its radially unlocked condition.

FIG. 6A depicts the collet type segmented seat 240 in its radially unlocked condition. In the radially unlocked condition, the segmented seat 240 is not able to catch a ball, dart, or other tool. To change the condition of the segmented seat 240 from the locked condition to the unlocked condition, the receiver 242 receives a signal communicated from the surface by a radio frequency identification device, a pressure pulse, or by other means known in the industry. When the receiver 242 receives the appropriate signal, the receiver 242 causes the actuator 244 to move the lock 246 upwards in channel 248. In the radially unlocked condition, the segmented seat 240 has a diameter 258 that is sufficient so that a ball, dart, or tool that could pass through the main bore 256 is able to pass through segmented seat 240.

Figure 6B:
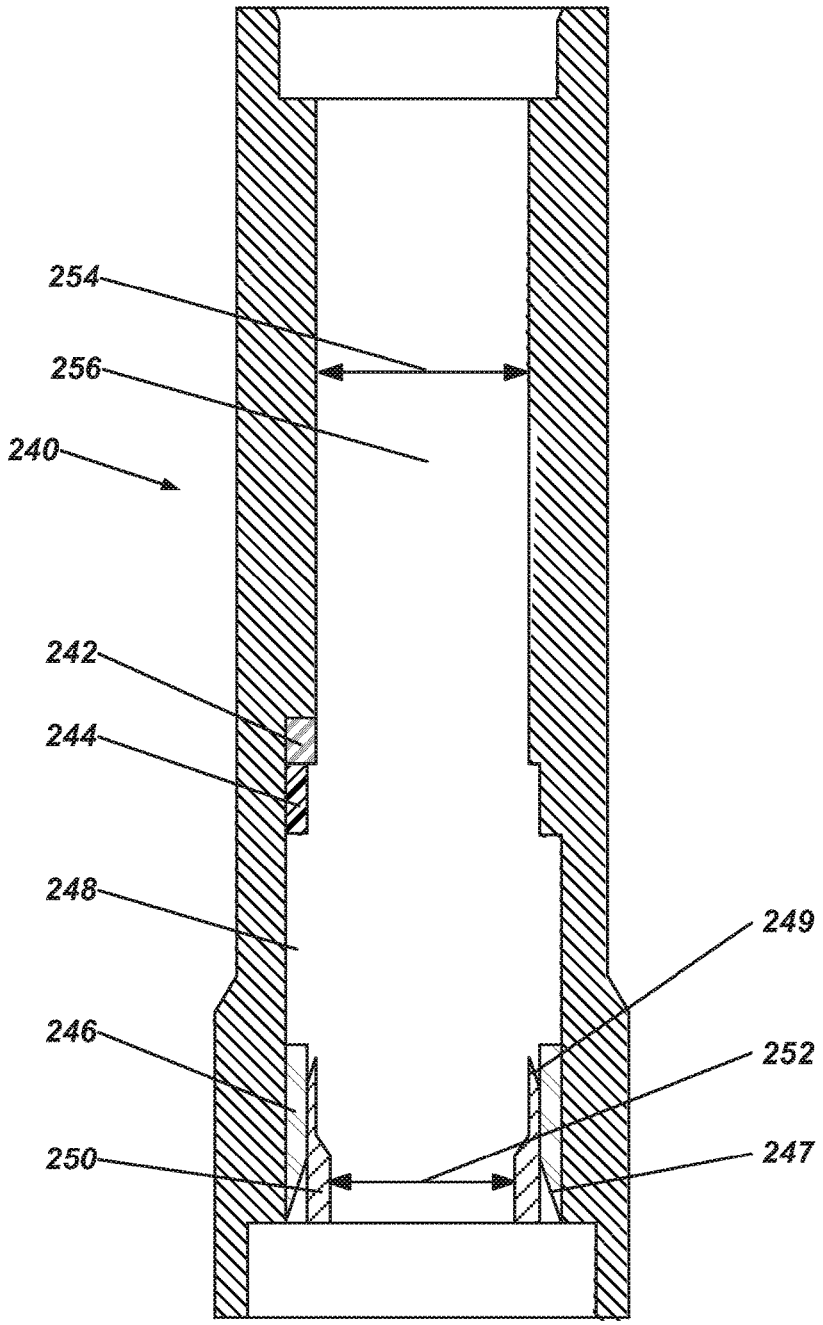
FIG. 6B depicts the collet type segmented seat in its radially locked condition.

FIG. 6B depicts the segmented seat 240 in its radially locked condition. In the radially locked condition, a ball, dart, or other tool, of the appropriate size, will be caught by the segments 250 of the segmented seat 240. To operate the segmented seat 240, a receiver 242 will receive a signal communicated from the surface by a radio frequency identification device, a pressure pulse, or by other means known in the industry. When the receiver 242 receives the appropriate signal, the receiver 242 causes the actuator 244 to move the lock 246 upwards or downwards. In the view depicted, the lock 246 is shown in its downward position in channel 248. As the lock 246 moves downward, a first surface 247 on the lock 246 interacts with a second surface 249 on the segmented seat pieces 250 such that each of the plurality of segmented seat pieces 250 is forced radially inwards so that in the radially locked condition the segmented seat has a diameter 252 that is less than the main bore diameter 254 such that a ball, dart, or tool that could pass through the main bore 256 will be caught by the segmented seat 240. The segmented seat 240 could be attached to a sliding sleeve (not shown) or other device where force needs to be applied across a ball and seat.

Figure 7A:
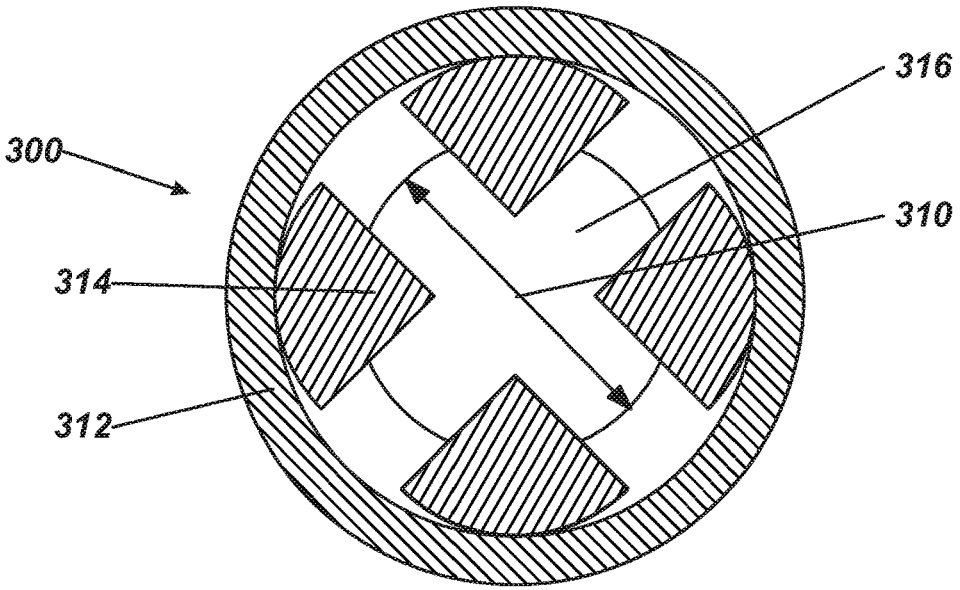
FIG. 7A is a top view of a segmented seal in the open position.

FIG. 7A is a top view of a segmented seal 300 that is similar in operation to the seat depicted in FIGS. 6A-6B. As shown in radially unlocked position, the flowpath may allow fluid or slurries to pass through the main bore 316. In some instances, as shown, the main bore diameter 310 may be restricted. Upon the receiver receiving a signal from the surface an actuator may move a locking ring longitudinally with respect to the tubular housing 312 to force each segment 314 of the segmented seal 300 radially inward.

Figure 7B:
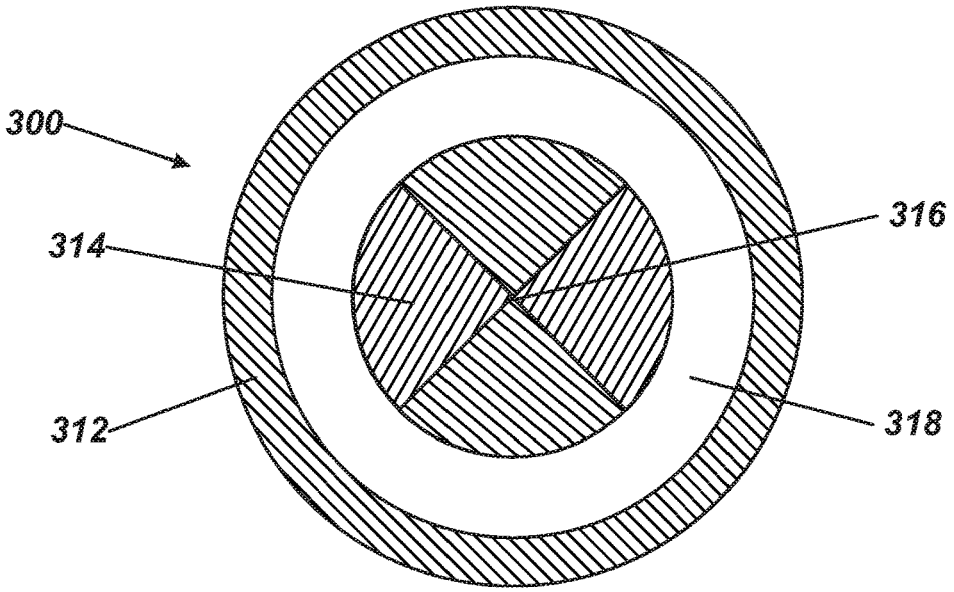
FIG. 7B is a top view of the segmented seal in the closed position.

FIG. 7B is again a top view of the segmented seal 300 that is similar in operation to the seat depicted in FIGS. 6A-6B. However, in the view shown, the segments 314 of the segmented seal 300 have been moved radially inward to block all flow through the main bore 316. The lock 318 will generally fill the annular area between the interior of the tubular housing 312 and a radially outward surface of the segments 314. With the lock in position between the tubular housing 312 and the segments 314 the segments 314 are prevented from unlocking and allowing fluid or slurry to pass through the main bore 316. The sealing surfaces between each of the segments 314 may be a metal to metal seal, an elastomeric seal, or any other seal known in the industry. In certain instances a less than perfect seal may be acceptable.

While the embodiments are described with reference to various implementations and exploitations, it will be understood that these embodiments are illustrative and that the scope of the inventive subject matter is not limited to them. Many variations, modifications, additions, and improvements are possible.

Plural instances may be provided for components, operations, or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A system for packing an annulus of a borehole around a wellscreen with gravel from a slurry, the system comprising:

a packer supporting the wellscreen in the borehole and having an internal seal in a first interior of the packer; and a washpipe landing on the internal seal and having a crossover tool, the crossover tool conducting the slurry from the washpipe to the borehole annulus, wherein the internal seal of the packer comprises a first variable diameter seat having at least two first segments positioned circumferentially about the first interior of the packer, and a first receiver, the at least two first segments movable between first and second positions relative to the first interior of the packer, the at least two first segments in the first position being unsealed with the washpipe, the at least two first segments in the second position sealing with the washpipe, and wherein the first receiver receives a first signal and moves the at least two first segments, in response to the first signal, between the first and second positions.

2. The system of claim 1, wherein the first receiver receives the first signal communicated by a radio frequency identification device.

3. The system of claim 1, wherein the first receiver receives the first signal communicated by a pressure pulse.

4. The system of claim 1, wherein the first receiver actuates a lock, the lock moving the at least two first segments between the first and second positions.

5. The system of claim 1, wherein the crossover tool comprises a port for conducting the slurry to the borehole annulus and comprises a second variable diameter seat adjacent the port, the second variable diameter seat comprising at least two second segments and a second receiver, the at least two second segments movable between third and fourth positions in a second interior of the crossover tool, the second receiver receiving a second signal and moving the at least two second segments, in response to the second signal, between the third and fourth positions.

6. The system of claim 5, wherein the at least two second segments move radially between the third position and the fourth position.

7. The system of claim 5, wherein the at least two second segments in the third position allow a plug to pass through the second interior; and wherein the at least two second segments in the fourth position catch the plug.

8. The system of claim 7, wherein the at least two second segments in the fourth position form a seal with the caught plug.

9. The system of claim 5, wherein the second receiver actuates a lock, the lock moving the at least two second segments between the third position and the fourth position.

10. The system of claim 5, wherein the second receiver receives the second signal communicated by a radio frequency identification device.

11. The system of claim 5, wherein the second receiver receives the second signal communicated by a pressure pulse.

12. The system of claim 5, wherein the second variable diameter seat comprises a collet having at least two fingers as the at least two second segments.

13. The system of claim 12, wherein the at least two fingers move radially between the third position and the fourth position.

14. The system of claim 12, wherein the at least two fingers in the third position allow a plug to pass through the second interior; and wherein the at least two fingers in the fourth position catch the plug.

15. The system of claim 14, wherein the at least two fingers in the fourth position form a seal with the caught plug.

16. The system of claim 12, wherein the second receiver actuates a lock, the lock moving the at least two fingers between the third position and the fourth position.

17. The system of claim 1, further comprising a valve disposed on the crossover tool and actuatable to communicate reverse circulation from the borehole uphole of the packer to inside the wellscreen.

18. The system of claim 17, wherein the valve is actuatable in response to a second signal.

19. A system for packing an annulus of a borehole around a wellscreen with gravel from a slurry, the system comprising:

a washpipe sealing adjacent the wellscreen; and a crossover tool disposed on the washpipe, the crossover tool having a port for conducting the slurry to the borehole annulus and having a first valve with a variable diameter seal adjacent the port, the first valve comprising at least two first segments and at least one receiver, the at least two first segments movable between first and second positions relative to an interior of the crossover tool, the at least two first segments in the first position opening the variable diameter seal of the first valve and allowing fluid communication through the first valve in the interior, the at least two first segments in the second position closing the variable diameter seal of the first valve to close off fluid communication through the first valve without the use of an additional plugging element in the interior and diverting the slurry to the port, the at least one receiver receiving a first signal and moving the at least two first segments, in response to the first signal, between the first and second positions.

20. The system of claim 19, wherein the at least one receiver receives the first signal communicated by a radio frequency identification device.

21. The system of claim 19, wherein the at least one receiver receives the first signal communicated by a pressure pulse.

22. The system of claim 19, wherein the at least one receiver actuates a lock, the lock moving the at least two first segments between the first position and the second position.

23. The system of claim 19, wherein the at least two first segments move radially between the first position and the second position.

24. The system of claim 19, further comprising a second valve disposed on the crossover tool and actuatable to communicate reverse circulation from the borehole uphole of the crossover tool to inside the wellscreen.

25. The system of claim 24, wherein the second valve is actuatable in response to a second signal.

* * * * *